US005549516A

United States Patent [19]

Heddon

[11] Patent Number: 5,549,516

[45] Date of Patent: Aug. 27, 1996

[54] BOWLING LANE CONSTRUCTIONS AND METHODS EMPLOYING COMPRESSIBLE FOAM

[76] Inventor: Will Heddon, 1025 N. Alternate 27, P.O. Box 340, Lake Hamilton, Fla. 33851

[21] Appl. No.: 291,432

[22] Filed: Aug. 16, 1994

Related U.S. Application Data

[63] Continuation-in-part of Ser. No. 100,029, Jul. 29, 1993, abandoned.

[51] Int. Cl.[6] ..... A63D 1/04

[52] U.S. Cl. ..... 473/115; 473/117

[58] Field of Search ..... 473/115, 117; 156/304.1, 308.4; 52/309.4, 309.5, 403.1, 817, 818

[56] References Cited

U.S. PATENT DOCUMENTS

| | | | |
|---|---|---|---|
| 2,788,973 | 4/1957 | Grawey | 473/115 |
| 4,169,602 | 10/1979 | Heddon | 473/115 |
| 4,205,842 | 6/1980 | Murreg et al. | 473/117 |
| 4,406,456 | 9/1983 | Berry et al. | 473/117 |
| 4,580,780 | 4/1986 | Gautraud et al. | 473/115 |
| 4,674,745 | 6/1987 | Speranza | 473/117 |
| 4,944,514 | 7/1990 | Suiter | 473/117 |
| 5,084,318 | 1/1992 | Stirling et al. | 473/117 |
| 5,316,521 | 5/1994 | Agre, Jr. | 473/117 |

*Primary Examiner*—V. Millin
*Assistant Examiner*—William M. Pierce

[57] ABSTRACT

A bowling lane construction and method utilizes either a synthetic substructure layer or synthetic bowling lane panels, or both, which are supported upon a compressible foam layer which dampens noise and vibration and also permits leveling from the upper surface utilizing leveling screws. The compressible foam layer comprises a double-backed adhesive foam tape which is used in lieu of fasteners for joining the construction together.

11 Claims, 2 Drawing Sheets

BOWLING LANE CONSTRUCTIONS AND METHODS EMPLOYING COMPRESSIBLE FOAM

RELATED APPLICATIONS

This application is a continuation-in-part of Ser. No. 08/100,029 filed on Jul. 29, 1993, now abandoned.

BACKGROUND OF THE INVENTION

The present invention relates generally to systems and methods for constructing bowling lanes, and in particular relates to such systems which utilize synthetic panels in the construction of a new bowling lane or in the replacement or resurfacing of an existing bowling lane.

The use of synthetic laminated constructions for bowling lanes is well known in the art. For example, the General Electric Company manufactured a bowling alley laminate under the trademark PERMA-LANE. This product was formed of many layers of kraft paper impregnated with a resin, and which was then laminated together to form a layer having a thickness on the order of ⅜–¾ of an inch. In U.S. Pat. No. 4,205,842, Murrey discloses such a high pressure phenolic layer having an exterior hard plastic melamine surface simulating a conventional wooden bowling alley in appearance. In Murrey's arrangement, fasteners are extended completely through the phenolic layer, and are used to attach an intermediate barrier layer to the lane substructure. In a similar arrangement disclosed in U.S. Pat. No. 5,084,318 to Stirling et al, fasteners are only partially extended through the phenolic layer, and are used to attach the phenolic as a resurfacing layer to an existing wooden bowling lane as part of a resurfacing activity.

One of the difficulties associated with synthetic bowling lanes in the past has been the tendency of panels formed of such laminated synthetic materials to warp during the period of shipping and installation, which hinders obtaining the necessary flat surface required by American Bowling Congress (ABC) regulations.

Another difficulty associated with synthetic bowling lanes involves the manner in which the lanes are fastened to the sub-structure. In the past, it has been known to use various mechanical fasteners and other similar mechanical systems for that purpose. For example, in the above described Murray U.S. Pat. No. 4,205,842 and related patents 4,205,843 and 4,244,570, there is disclosed the use of a thin phenolic layer placed on top of an aluminum underlayment sheet using mechanical fasteners; a similar system is disclosed in the Sterling et al U.S. Pat. No. 5,084,318.

Other prior art of interest is disclosed in the following U.S. Pat. Nos.: 3,670,049 to Stein et al; 3,014,722 to Green; 2,531,168 to Snyder; 4,944,514 and 4,795,152 to Suiter; and 5,183,262 to Heddon.

SUMMARY OF INVENTION

In a first example, the present invention contemplates a method for forming a warp-resistant bowling lane by utilizing plural synthetic panels fixed to a bowling substructure employing fastening means, such as adhesives, which does not require the use of mechanical fasteners across the central field of each panel. To this end, each panel is imparted with a substantially balanced construction across its upper and lower surfaces, in terms of the control exercise over the ability of the panel to warp.

To this end, the characteristics of each panel are controlled at both of its upper and lower surfaces to insure that the expansion—and thus warping—capabilities are controlled to maintain the panel substantially flat both during and after the installation of the panel in an edge to edge configuration with adjacent panels, thereby avoiding the necessity for the use of mechanical fasteners across the central field of the panel, even where mechanical fasteners may be required to insure that the edges of adjacent panels are horizontally flush.

In one arrangement, the balanced construction of each panel is obtained by providing a flat, resin-impregnated layer having opposing first and second sides, and then laminating both of the sides of the resin-impregnated layer with at least one sheet of a similarly resin-impregnated material also containing a metal oxide. In one particular embodiment, the additional ingredient is aluminum oxide.

While the use of a laminated sheet containing aluminum oxide along the upper surface of a synthetic bowling lane has been used in the past, it has been found that the balancing of the characteristics of the synthetic layer can be achieved by laminating one or more additional metal oxide-containing sheets to the bottom surface of the panel as well. It has been determined that bowling lane panels fabricated in this way retain the desired flatness after the lamination process. While the technical reasons why this occurs is not completely understood, it is believed that the lamination of additional metal oxide-containing sheets to the bottom surface of the synthetic layers either creates a barrier against moisture absorption, or adjust the coefficient of expansion of the combined lamination, or both, so as to permit the synthetic layer to retain its desired flatness during extended periods of shipping and installation.

Since the synthetic panels used in an edge-to-edge configuration in accordance with the present invention maintained their desired flatness after shipping, installation and extended periods of use, then these improved synthetic panels may be installed by utilizing an adhesive layer, or preferably a double-back adhesive tape having a thickness on the order of about 30 mils. The improved synthetic panels are then installed on to the double-backed adhesive tape, and the adjacent edges are drawn into the desired horizontal evenness utilizing mechanical fasteners, such as finishing nails.

In a second example, the present invention contemplates a bowling lane construction and related method which utilizes synthetic panels not only for the upper bowling lane, but also in the construction of the substructure to which the bowling lane panels are affixed. In accordance with this invention, a layer of a compressible foam is placed between the synthetic substructure and the underlying support (i.e., the conventional lateral stringers underneath the substructure), and an additional layer of compressible foam is disposed between the synthetic bowling lane panels and the synthetic substructure. The compressible foam functions both as a dampening material to reduce vibration and noise, and also permits both the substructure panels and the bowling lane panels to be easily leveled from the respective upper surfaces utilizing leveling screws extending through the panels at those locations where leveling is required. In the preferred form of the present invention, the compressible dampening foam is on the order of at least ½–¾ inch in thickness, has a density on the order of between 6 and 9 (PCF), and a compression deflection on the order of 5–10 PSI, has an adhesive deposited on both sides thereof to facilitate in the first instance the fastening of the substructure to the stringers, and in the second instance the fastening of the bowling lane panels to the upper surface of the substructure. To this end, the preferred form of the compressible dampening foam comprises a so called "double-backed" foam tape having the adhesive deposited on the respective upper and lower surfaces, and with a contact paper covering the adhesive surfaces until such time as required in the construction of the bowling lane.

Bowling lanes constructed in accordance with the techniques and methods of this invention achieve a number of advantages which will be clearly understood by those skilled in the art with reference to the accompanying drawings and the detailed description set out below.

THE DRAWING

DETAILED DESCRIPTION

Figure 1:
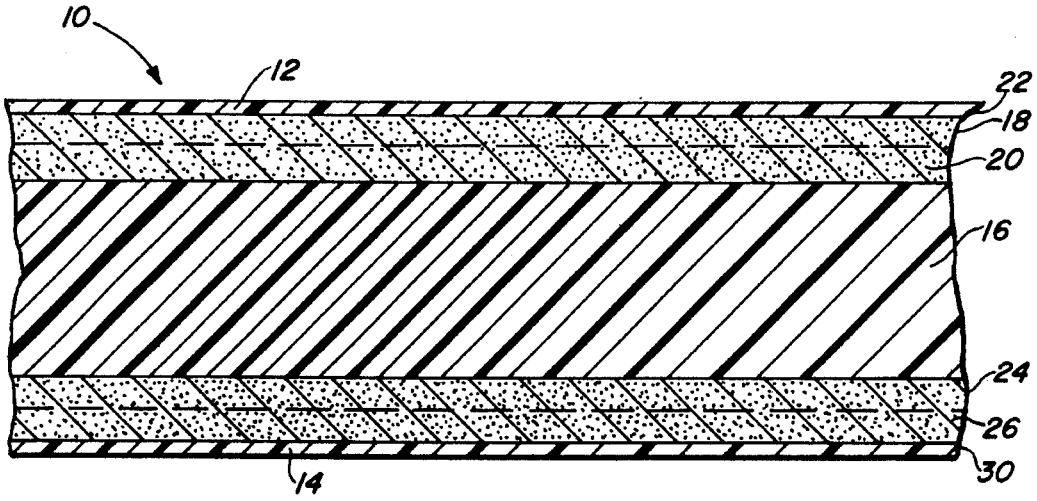
FIG. 1 is a cross section of an improved synthetic bowling lane panel in accordance with the first example of the present invention, in which stippling is used to identify the metal oxide-containing sheets laminated to opposing sides of the composite laminate.

A preferred embodiment of the construction for a synthetic bowling lane with a bowling panel in accordance with the second example of the present invention will now be described with reference to FIG. 1.

The panel 10 has upper and lower surfaces 12, 14 respectively and a central layer 16 formed of a plurality of resin-impregnated laminated kraft sheets. It is of course well-known to simultaneously laminate an aluminum oxide-containing sheet to the central layer of a synthetic bowling lane. However, in accordance with the present invention, there is laminated to the central layer at both the upper and lower surfaces 12, 14 at least one, and preferably two, metal oxide-containing sheets. In the particular arrangement of FIG. 1, the two sheets laminated with the central layer 16 at the upper surface 12 are designated as layers 18 and and the two sheets at the bottom surface 14 are designated as sheets 24.26. Conventionally, the upper and lower surfaces 12, 14 have respective finishing sheets 22, 30 of melamine.

As has been described above, an improved synthetic bowling lane panel 10 fabricated in accordance with the construction shown in FIG. 1 substantially maintains its desired degree of flatness throughout the process of shipping and installation, despite exposure to high humidity conditions which often occur during those periods.

A bowling lane installation utilizing plural improved synthetic panels of the construction shown in FIG. 1 in an edge-to-edge configuration is depicted in the cross-sectional view shown in FIG. 2, described next.

Figure 2:
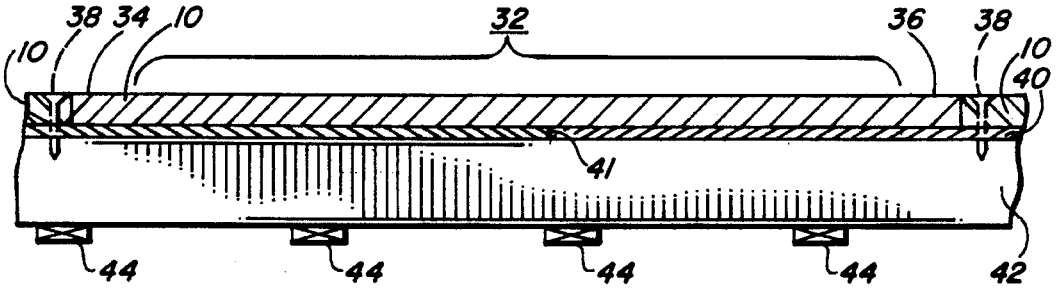
FIG. 2 is a cross-sectional side view of a bowling lane construction utilizing the improved synthetic panel of FIG. 1.

In FIG. 2, there is provided a conventional bowling lane substructure 42, which may either comprise an existing wooden bowling lane, or a newly installed substructure, and which is supported by lateral stringers 44 extending across the bowling lane lateral to the direction between the approach area and the pit area (not shown). A double-backed adhesive tape 40 on the order of 30 mils in thickness is extended across the upper surface of the substructure 42, with any joint 41 of the adhesive tape being positioned between edge-to-edge joints of the improved synthetic bowling panels 10.

A plurality of the improved synthetic bowling lane panels 10 are then attached to the upper surface of the adhesive double-backed tape 40 in an edge-to-edge configuration. In FIG. 2, a middle one of the panels 10 is shown, with the central field of the panel 10 being designated with reference numeral 32, and with the opposing edges with reference numerals 34 and 36. Because of the improved characteristics of the synthetic panel 10 as shown in FIG. 1, each panel 10 may be attached to the substructure 42 by use of the adhesive double-backed tape 40 (or a layer of conventional adhesives) without the use of any mechanical fasteners across the central portion 32. However, since the thickness of the laminated synthetic panels 10 can only be controlled within a certain tolerance, it may be necessary to use mechanical fasteners 38, for example finishing nails, to insure that an edge is forced sufficiently downwardly into the plane of the adhesive double-backed tape 40, to thereby achieve the evenness at the edge-to-edge joint with the next adjacent synthetic panel 10.

It will thus be appreciated by those skilled in the art that the improved synthetic panel construction of this first example of the present invention insures that the improved panel remains flat during all periods of shipping, installation and extended use, thereby avoiding the necessity for utilizing mechanical fasteners across the central field of the panel.

Figure 3:
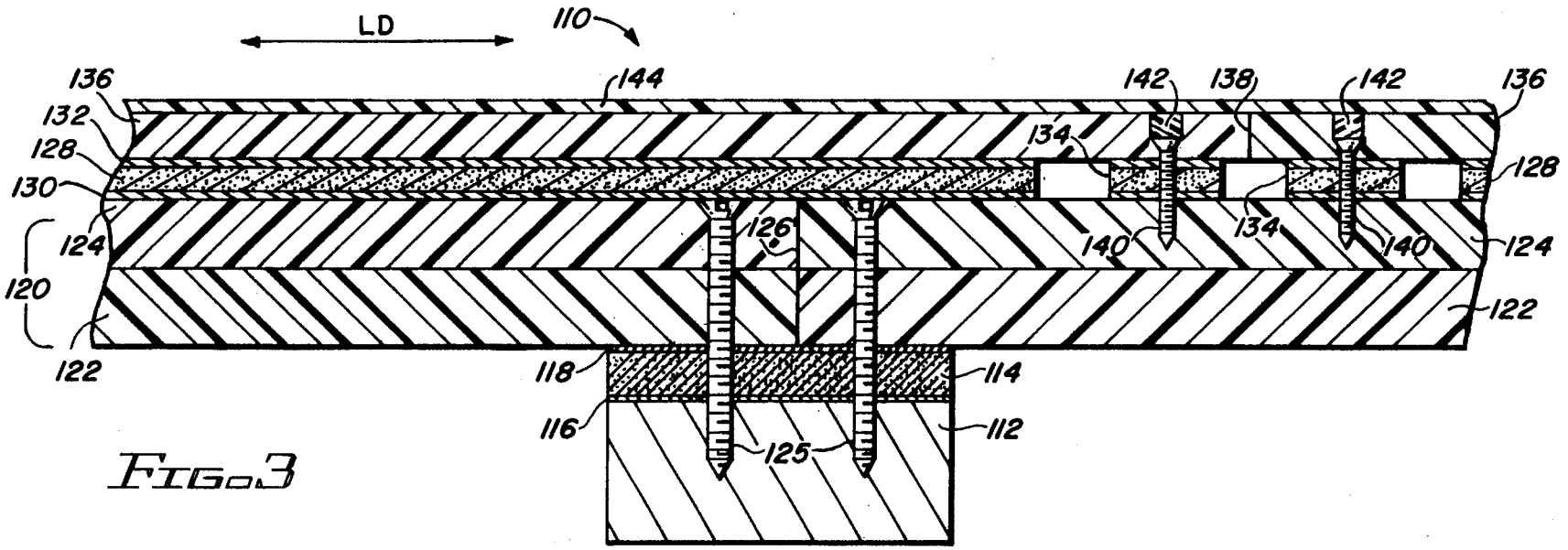
FIG. 3 is a cross sectional illustration of a bowling lane construction in accordance with the second example of the present invention.

Referring now to FIG. 3, there is illustrated a bowling lane construction 110 in accordance with the second example of the present invention. In FIG. 3, the arrow designated "LD" is used to identify the "lane direction" that is the longitudinal direction between the approach area and the pit area of the bowling lane. Thus, in play a bowling ball would, for example, travel from left to right along the construction 110 illustrated in FIG. 3.

The construction 110 utilizes conventional stringers 112 which typically comprise either wood or steel 2 inch by 4 inch members extending lateral to the lane direction LD. It will of course be understood that a plurality of the stringers 112 extend laterally underneath the bowling lane construction (note the right side of FIG. 4). In accordance with the present invention, there is deposited upon the top surface of the stringer 112 a layer of compressible foam tape 114 of the density and thickness described above, and having respective adhesive layers 116, 118 deposited on the lower and upper surfaces thereof. As indicated in the previous discussion, the compressible foam tape 114 preferably is a double-backed tape having the adhesive pre-disposed on the upper and lower surfaces, with a protective contact paper covering the adhesive surfaces until the tape 114 is ready for use.

The bowling lane construction 110 further includes a relatively thick substructure layer 120, which in the example of FIG. 3 comprises two relatively thick layers of phenolic laminate 122, 124. As is well known, such panels are formed by the lamination of a plurality of sheets of kraft paper which has been impregnated with a phenolic resin and then subjected to a high pressure to laminate the sheets together. As shown in FIG. 3, the upper and lower panels 122, 124 which form the layer 120 have a common joint 126 with the next adjacent substructure panel 122, 124, with the joint 126 being positioned approximately centrally over the compressible foam tape 114 and the associated stringer 112. Since the panels 122, 124 are approximately 12 feet in length, it will be appreciated that a joint 126 does not overlie each and ever stringer; however, the stringers 112 and the associated tape layer 114 are positioned such that every joint 126 is supported by a stringer 112 and associated compressible tape layer 114.

As shown in FIG. 3, leveling screws 125 may be extended through the substructure panels 122, 124 from the upper surface of the substructure layer 120 as required, in order to make the joint 126 level. It is to be emphasized, however, that the screws 125 are not required in each instance, and are only necessary when leveling is needed. That is to say, the adhesive surfaces of the foam tape 114 over all of the stringers 112 are sufficient to hold the substructure layer 120 in place, and fasteners 125 are only extended through the substructure layer 120 as required for leveling. By way of example, four such leveling screws 125 are shown in FIG. 4; however, it will be appreciated that leveling screws 125 may not be required in every instance.

Further in accordance with the present invention, there is deposited upon the upper surface of the substructure layer 120 a pattern of compressible foam strips 128, 129 and 134 which provide a facile support for the plural synthetic bowling lane panels 136 deposited over the substructure (as shown in FIG. 3), and with the pattern of compressible foam strips also facilitating the leveling of the bowling lane panels 136 and easy removal at a later time as required. With reference to both FIGS. 3 and 4, a plurality of longitudinal foam strips 128 are placed upon the upper surface of the substructure layer 120. As is shown by the longitudinal foam strips 128 on the right side of FIG. 4, these strips 128 run almost the full length of the respective bowling lane panel (which is removed in FIG. 4) as is shown by the longitudinal strips 128 on the right side of FIG. 4. However, in the case of that bowling lane panel which mates with the approach panel and the approach panel joint (respectively designated "AP" and "APJ" in FIG. 4), somewhat wider foam strips 129 are applied in the area which typically forms the ball drop zone BDZ, in order to provide a greater dampening effect in that zone.

Figure 4:
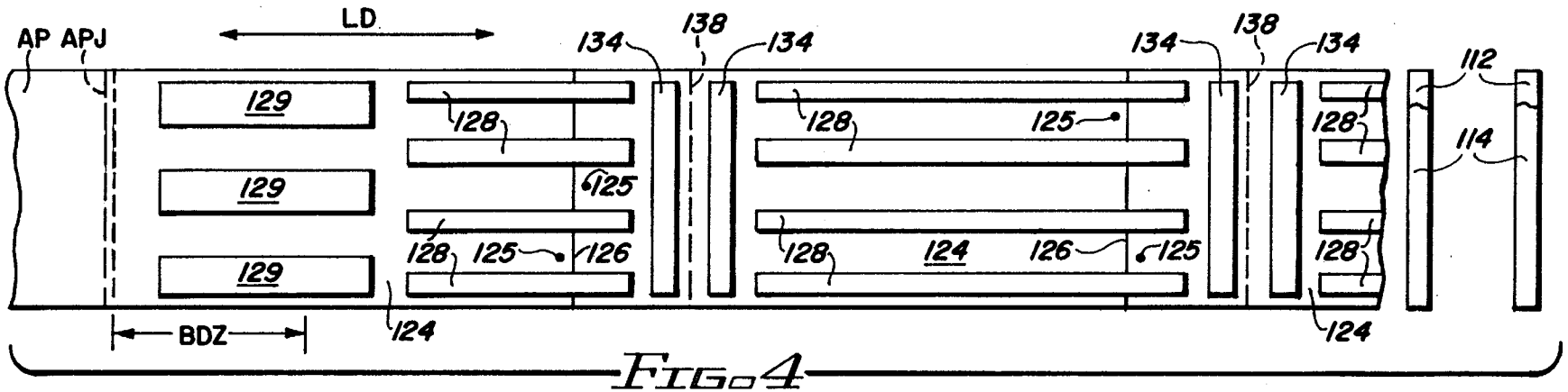
FIG. 4 is a top plan view of the substructure of a bowling lane constructed in accordance with the second example of the present invention, and illustrating the layout pattern of the compressible foam placed upon the upper surface of the substructure.

As is further illustrated in FIG. 4, there is also provided lateral foam strips 134 positioned between the respective ends of adjacent sets of the longitudinal strips 128. As is illustrated by the dotted lines in FIG. 4, each pair of lateral foam strips 134 is positioned one on each side of the joint 138 between adjacent bowling lane panels 136, as is described in greater detail below. As will be appreciated from the cross section of FIG. 3, the foam strips 128, 129 and 134 also include lower and upper adhesive layers 130, 132 in the same manner as the tape 114 deposited upon the upper surface of the stringers 112.

Referring again to FIG. 3, there is provided a plurality of synthetic bowling lane panels 136 which are disposed atop the underlying longitudinal and lateral foam strips 128, 129 and 134 in such a manner as to place the joints 138 between adjacent bowling lane panels 136 between a pair of the lateral foam strips 134. Preferably, the lane panels 136 are formed of the balanced panel construction disclosed above with reference to the first example and FIGS. 1 and 2. As is further shown in FIG. 3, leveling screws 140 may be extended from the upper surface of the bowling lane panels 136, through the level of the foam strips 128, 129 or 134 and into the substructure layer 120 as required for leveling purposes. Again, however, it is emphasized that the leveling screws 140 are not necessary for purposes of holding the bowling lane panels 136 to the substructure layer 120, as the adhesive surfaces of the strips 128, 129 and 134 are sufficient for maintaining the bowling lane panels 136 in rigid relation to the substructure Instead, the leveling screws 140—like the fasteners 125—are used only for leveling the bowling lane panels 136 from the upper surface thereof. Typically, when such leveling screws are used, the holes receiving the screws are tapped, and the tap hole is then filled with an appropriate material 142. The entire bowling lane construction 110 may then be finished as desired by the application of a protective or decorative film 144.

It will be appreciated by those skilled in the art that the bowling lane construction described above and shown in FIGS. 3 and 4 provides an arrangement in which both the substructure and the bowling lane panels may be fabricated from synthetic materials, while utilizing a compressible dampening system which significantly reduces undesirable noise and vibration, and at the same time provides a means by which the entire bowling lane construction may be fastened together without the use of time-consuming fasteners. On the other hand, screws may be employed on a limited basis solely for leveling either the substructure layer or the bowling lane panels, by easily utilizing a bit and brace technique with the leveling screws 125, 140 from the respective upper surface of the substructure layer 120 or the bowling lane panels 136. In the event that it is necessary to remove the bowling lane panels 136 or the substructure layer 120 for repair or replacement, the use of the double-backed adhesive tape and the particular strip layout permits the lane to be easily and quickly disassembled.

This concludes the description of the preferred embodiments. A reading by those skilled in the art will bring to mind various changes without departing from the spirit and scope of the invention. It is intended, however, that the invention only be limited by the following appended claims.

What is claimed is:

1. A construction for a bowling lane having an approach area at one end of the lane and a pit area at another end, the construction comprising:

a layer of plural lane support panels extending along the bowling lane between the approach area and the pit area;

plural strips of compressible foam overlying an upper surface of the layer of lane support panels and extending in a longitudinal direction between the approach area and the pit area; and a layer of plural lane panels overlying the longitudinal foam strips, each lane panel having opposing ends with each end fitted in an end-to-end joint with an adjacent lane panel.

2. The construction recited in claim 1 wherein each end-to-end joint of the layer of lane panels is spaced between the end-to-end joints of the layer of lane support panels between the approach and pit areas.

3. The construction recited in claim 1 further comprising a plurality of fasteners extending laterally across, and into each end of each lane panel and into the layer of lane support panels.

4. The construction recited in claim 3 further comprising a continuous plastic coating over the lane panels, the end-to-end joints of the lane panels, and the fasteners.

5. The construction recited in claim 4 wherein the continuous coating comprises a plastic sheet adhesively bonded to the lane panels.

6. The construction recited in claim 3 wherein the longitudinal foam strips extend short of the ends of the lane panels, and further comprising a strip of the compressible foam material extending laterally across the lane between each end of each lane panel and the layer of lane support panels, with the fasteners extending through the corresponding lateral foam strip.

7. The construction recited in claim 6 wherein each longitudinal foam strip comprises a discontinuity at each end of each lane panel.

8. The construction recited in claim 1 wherein the lane panels comprise a resin laminate.

9. The construction recited in claim 1 wherein the lateral and longitudinal foam strips comprise a foam strip tape having an adhesive on both sides thereof.

10. A construction for a bowling lane, having an approach area at one end of the lane and a pit area at another end, the construction comprising:

a substructure extending in a longitudinal direction between the approach area and the pit area;

a plurality of lane panels extending in the longitudinal direction between the approach area and the pit area and overlying the substructure; and strips of a compressible foam dampening material extending along the longitudinal direction and between the lane panels and the substructure.

11. The construction recited in claim 10, wherein the substructure comprises plural stringers and a substructure layer between the stringers and the lane panels, the construction further comprising lateral strips of a compressible synthetic material between the stringers and the substructure layer.

* * * * *